US009336663B1

(12) United States Patent
Cohen et al.

(10) Patent No.: US 9,336,663 B1
(45) Date of Patent: May 10, 2016

(54) ALARM SYSTEM AND ENCLOSURE

(71) Applicants: Michael Cohen, Newtown, PA (US); Sydney Heese, Washington Crossing, PA (US)

(72) Inventors: Michael Cohen, Newtown, PA (US); Sydney Heese, Washington Crossing, PA (US)

( * ) Notice: Subject to any disclaimer, the term of this patent is extended or adjusted under 35 U.S.C. 154(b) by 507 days.

(21) Appl. No.: 13/913,574

(22) Filed: Jun. 10, 2013

Related U.S. Application Data

(60) Provisional application No. 61/758,996, filed on Jan. 31, 2013.

(51) Int. Cl.

| | |
|---|---|
| ***G08B 13/00*** | (2006.01) |
| ***G08B 13/02*** | (2006.01) |
| ***G08B 13/196*** | (2006.01) |
| ***F41C 33/06*** | (2006.01) |
| ***E05G 1/00*** | (2006.01) |

(52) U.S. Cl.
CPC ..... *G08B 13/02* (2013.01); *E05G 1/005* (2013.01); *F41C 33/06* (2013.01); *G08B 13/19619* (2013.01); *G08B 13/19697* (2013.01)

(58) Field of Classification Search
CPC ..... G08B 13/19697; G08B 13/19619; F41C 33/06; Y10T 70/5031; E05G 1/005
USPC ..... 340/541, 506, 568.1; 70/63; 109/50
See application file for complete search history.

(56) References Cited

U.S. PATENT DOCUMENTS

| | | | | |
|---|---|---|---|---|
| 4,768,021 | A | 8/1988 | Ferraro | |
| 5,374,919 | A | 12/1994 | Zelka et al. | |
| 5,416,826 | A | 5/1995 | Butler | |
| 5,489,045 | A | 2/1996 | Jennings | |
| 5,579,909 | A | 12/1996 | Deal | |
| 5,916,087 | A | 6/1999 | Owens | |
| 6,363,760 | B1 | 4/2002 | Sigmond | |
| 6,400,269 | B1 | 6/2002 | Savastano | |
| 6,552,963 | B2 | 4/2003 | Baranek et al. | |
| 6,970,183 | B1 * | 11/2005 | Monroe | 348/143 |
| 7,116,224 | B2 | 10/2006 | Mickler | |
| 7,178,370 | B2 | 2/2007 | Engel | |

(Continued)

FOREIGN PATENT DOCUMENTS

| | | |
|---|---|---|
| FR | 2944551 | 5/2011 |
| GB | 2395045 | 5/2004 |

(Continued)

OTHER PUBLICATIONS

Abstract of FR2944551 published on May 13, 2011, abstract only in English, 1 page.

*Primary Examiner* — John A Tweel, Jr.
(74) *Attorney, Agent, or Firm* — Eric L. Sophir; Dentons US LLP

(57) ABSTRACT

An alarm system described herein can be used in commercial, public, or governmental buildings and can be activated by any individual when an intruder poses imminent threat; can contain a portable, removable, self-defense mechanism; can notify everyone within the building of the threat; records surveillance video; and can immediately notify police of an intruder posing serious threat to the public. There remains a vital need in public, commercial, residential and governmental buildings for a robust intruder alarm system that protects the public, warns other patrons, notifies the police, and records crime scene information. The embodiments disclosed herein attempt to provide a method and apparatus for protecting people in the presence of a threatening intruder.

20 Claims, 7 Drawing Sheets

(56) References Cited

U.S. PATENT DOCUMENTS

| | | | | |
|---|---|---|---|---|
| 7,990,805 | B2 | 8/2011 | Kumhyr et al. | |
| 8,258,949 | B1 | 9/2012 | Jaynes | |
| 8,327,777 | B2 | 12/2012 | Heim et al. | |
| 8,770,117 | B2 * | 7/2014 | Wall et al. | 109/48 |
| 2002/0057365 | A1 | 5/2002 | Brown | |
| 2009/0121861 | A1 | 5/2009 | Latham et al. | |
| 2010/0128123 | A1 | 5/2010 | Dipoala | |
| 2010/0149336 | A1 | 6/2010 | Wang et al. | |
| 2011/0175730 | A1 | 7/2011 | Stevenson | |
| 2012/0228243 | A1 | 9/2012 | Crigger et al. | |
| 2012/0314083 | A1 | 12/2012 | Ratliff et al. | |
| 2012/0325127 | A1 | 12/2012 | Adrain | |
| 2015/0130609 | A1 * | 5/2015 | Jacobs | 340/517 |

FOREIGN PATENT DOCUMENTS

| | | |
|---|---|---|
| WO | WO2005010843 | 2/2005 |
| WO | WO2005013031 | 6/2005 |
| WO | WO2010045711 | 4/2010 |

* cited by examiner

ALARM SYSTEM AND ENCLOSURE

CROSS-REFERENCE TO RELATED APPLICATIONS

This application claims the benefit of U.S. Provisional Patent Application Ser. No. 61/758,996, filed Jan. 31, 2013, entitled "Alarm System and Enclosure," which is hereby incorporated by reference in its entirety.

TECHNICAL FIELD

The present invention relates generally to an alarm system for countering terrorism, and more particularly, to an alarmed enclosure that contains multiple notification mechanisms and a removable self-defense mechanism.

BACKGROUND

Gun violence has become an epidemic in the United States. In 2010, there were more than 11,000 gun-related homicide deaths in the United States. Some of the notorious gun-related massacres happened in 1999 at Columbine High School in Columbine, Colo., in 2007 at Virginia Tech in Blacksburg, Va., in 2012 at a movie theater in Aurora, Colo., and in 2012 at Sandy Hook Elementary School in Newtown, Conn. The United States government is engaging in ongoing discussions to determine ways to combat gun violence. Some safety proposals include placing armed guards at every school despite the fact that armed guards were present during the Columbine High School massacre.

Currently, there are multiple types of safety devices placed in schools and other public venues. These devices are routinely manual fire alarm pull stations, water or gas fire extinguishers, portable cardiac defibrillators, or first aid kits. Manual fire alarm pull stations are the only universally present alarm system where a public patron can actively notify authorities immediately; however, in case of an intruder, the wrong authorities (fire) are notified, and police are not notified of the impending danger from an armed intruder. Even though firearms are pervasive, there is currently no alarm system in commercial buildings that the public can activate in order to immediately notify police an intruder with a firearm is present. None of the current safety devices are designed specifically for when an armed intruder is present and could provide a lethal or non-lethal self-defense mechanism for the patron, to alert all of the occupants within an establishment, and to notify police of the armed intruder.

The need to secure personal firearms has led to the development of many safeguard products including locking gun racks, gun safes and cases, and alarmed firearm enclosures. Most of these conventional products are designed to make personal firearm ownership safer within a residence. In one conventional attempt, a deterrent gas is dispensed when inappropriate access to the inner contents occurs.

SUMMARY

None of the conventional attempts can provide an alarm system that is designed to be used in commercial, public, or governmental buildings and can be activated by any individual when an intruder poses imminent threat; can contain a portable, removable, self-defense mechanism; can notify everyone within the building of the threat; records surveillance video; and can immediately notify police of an intruder posing serious threat to the public. There remains a vital need in public, commercial, residential and governmental buildings for a robust intruder alarm system that protects the public, warns other patrons, notifies the police, and records crime scene information. The embodiments disclosed herein attempt to provide a method and apparatus for protecting people in the presence of a threatening intruder.

In one embodiment, an alarm device comprises an enclosure configured to be secured to a wall in a publicly accessible location, the enclosure comprising a door to access an interior of the enclosure; a removable self-defense item in the interior of the enclosure that is accessible by opening or removing the door, wherein accessing the removable self-defense item activates an alarm signal of the enclosure; an audio or visual notification device associated with and electrically coupled to the enclosure, wherein the audio or visual notification is activated upon activation of the alarm signal; a microphone electronically coupled to the enclosure and configured to automatically record an audio signal upon activation of the alarm signal of the enclosure; a camera electronically coupled to the enclosure and configured to automatically record a video signal upon activation of the alarm signal of the enclosure; and a message transmission system electrically coupled to the enclosure that sends a notification message to a first responder entity.

In another embodiment, an alarm system comprises at least one alarm device enclosing a self-defense item that is accessible upon an alarm trigger; a control panel electronically coupled to the at least one alarm device and is configured to receive a notification from an alarm device that has received an alarm trigger; and an alarm monitoring call station electronically coupled to the control panel and is configured to transmit messages to a first responder entity.

In yet another embodiment, a method for activating an alarm comprises unlocking a door of an alarm device, thereby allowing access to a removable self-defense item and activating an alarm trigger; and upon receiving the alarm trigger: activating an audio or visual notification associated with the alarm device; automatically recording a video signal of a camera and an audio signal of a microphone associated with the alarm device; and transmitting an alarm signal to a central control panel.

Additional features and advantages of an embodiment will be set forth in the description which follows, and in part will be apparent from the description. The objectives and other advantages of the invention will be realized and attained by the structure particularly pointed out in the exemplary embodiments in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings constitute a part of this specification and illustrate an embodiment of the invention and together with the specification, explain the invention.

DETAILED DESCRIPTION

Figure 1:
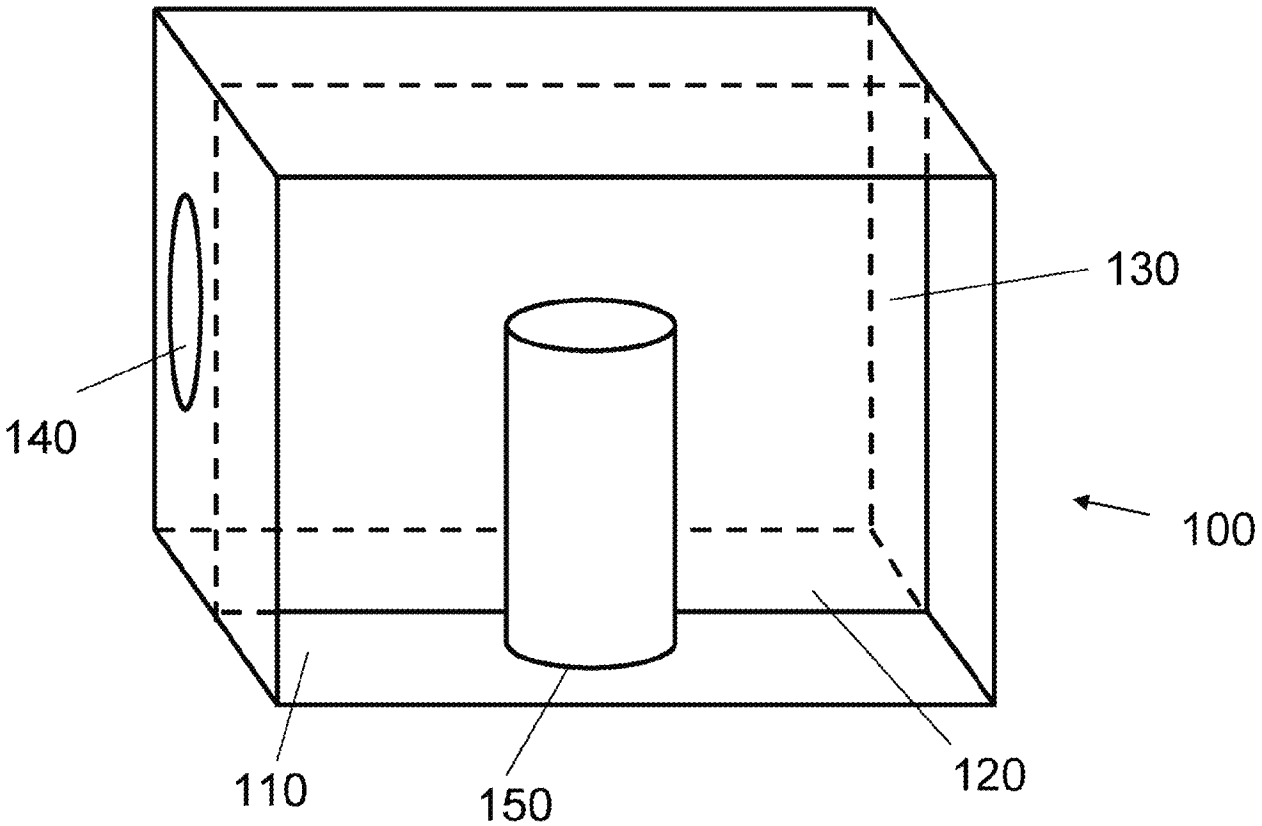
FIG. 1 is a perspective view of an alarm enclosure according to an exemplary embodiment.

Reference will now be made in detail to the preferred embodiments, examples of which are illustrated in the accompanying drawings.

The embodiments described above are intended to be exemplary. One skilled in the art recognizes that numerous alternative components and embodiments that may be substituted for the particular examples described herein and still fall within the scope of the invention.

In one aspect, an activation mechanism can be provided on the front of a secure device. Multiple renditions of the activation mechanism are proposed herein, including but not limited to a single-step unlock mechanism, a dual-step unlock mechanism, a multiple step unlock mechanism, a numerical password-protected touchpad, a security badge access, a key access, a fingerprint or other biometric recognition (e.g., retina display) mechanism, or any other locking mechanism.

Once the device is activated, multiple actions can be initiated. The device can trigger one of multiple alarms, including visual and/or audio alerts. The visual alarm is ideally a repetitive bright light or strobe light. The audio alarm ideally repeats from an internal speaker "Intruder" or other desired message. The repeated audio intentionally has repeated silence after the audible alert. The moment of silence after each repetitive audible alarm allows for the activating person to speak into the microphone and recording of audio information from the scene on the device and transmitted.

Upon activation of the device, both audio and visual information can also be recorded and transmitted. The device has circuitry enclosed within a protective casing. An enclosed video camera and microphone allows video and audio to be recorded and stored within the device and/or transmitted via hardwire, wireless, or other transmission device to a central control panel. The central control panel transmits information to a central alarm monitoring station. The recording devices can also record audio and video as a continuous loop for a specific timeframe and overwrite itself within the internal memory, for example, 8 hours or every 24 hours.

Multiple intruder alarm activation devices can be coupled to one central control panel. The central control panel determines which alarm was initially triggered and can determine where to initiate recording, e.g., in one or multiple locations. The central control panel can then send a signal to the non-activated intruder alarms to activate audio and visual alarms and begin their audio and visual recording and transmission mechanisms. The recorded audio and visual information from each intruder alarm activated device can be transmitted to the central control panel and then can also be transmitted and monitored by an alarm monitoring company and/or emergency personnel, which may be transmitted via a secured encrypted mechanism. All of the audio and video information can be securely recorded for future investigative review.

The device can also have a cavity or chamber with a door, lid, or cover. The door can be in a locked or unlocked position. A locked door can be unlocked in multiple manners, including but not limited to numerical password protected touchpad, security badge access, key access, biometric (e.g., fingerprint or retina) recognition, or any other locking mechanism. An unlocked door can be opened with a single, dual-step, or multiple step opening mechanism to minimize accidental or mischievous activation. The cavity can contain any lethal or non-lethal self-defense item that can be used to stop an intruder. Examples of self-defense items include a loaded firearm, a stun-gun, a taser, or a bottle of a human or animal deterrent, such as pepper spray, bear spray, tear gas, or other forthcoming portable self-defense item. Prior to storing the self-defense item in the cavity, it can be coated with a special powder to assist future crime scene investigators for finger print identification.

Referring to FIG. 1, an alarm enclosure 100 is shown with a door (not shown) removed. Although the exemplary embodiment depicts that the door is removed, the door may alternatively be hinged or otherwise attached to a side of the enclosure and opened without removal. The enclosure 100 can be secured to a wall or surface. In the exemplary embodiment, a rear or lower surface of the enclosure 100 is secured to a wall or surface.

The enclosure 100 is a rectangular shape, though any shaped housing can be used that is commensurate with this disclosure. The enclosure 100 has two chambers. A first chamber 110 is accessible from a front side of the enclosure 100. A second chamber 120 is not accessible from the front side of the enclosure. The second chamber 120 may be entirely enclosed, but may be accessible through an opening in a side of the enclosure 100. As shown in this embodiment, a wall 130 may separate the first chamber 110 from the second chamber 120. The second chamber 120 may house electrical components associated with an alarm system for the enclosure 100. The enclosure may include an audio alarm 140 that sounds a horn, message, or other audio when an alarm is triggered.

The enclosure 100 may house a self-defense item 150 in the first chamber 110. Options for the removable self-defense item 150 include, but are not limited to, a loaded firearm, unloaded firearm, a stun-gun, or a taser, or a bottle of a human or animal deterrent, such as spray, bear spray, tear gas, or any portable self-defense mechanism. The active ingredient in pepper spray is Oleo-resin Capsicum (OC). Bear spray contains the same active ingredient as pepper spray; however, the concentration of the OC is greater. Bear spray is also designed to contain a larger volume and dispense at a further distance than standard human pepper spray. The self-defense item 150 can be coated with a special material or powder before being stored within the enclosure 100. The material or powder can be used to identify a user of the self-defense item 150 or can help crime scene investigators track individuals who used the self-defense object.

Figure 2:
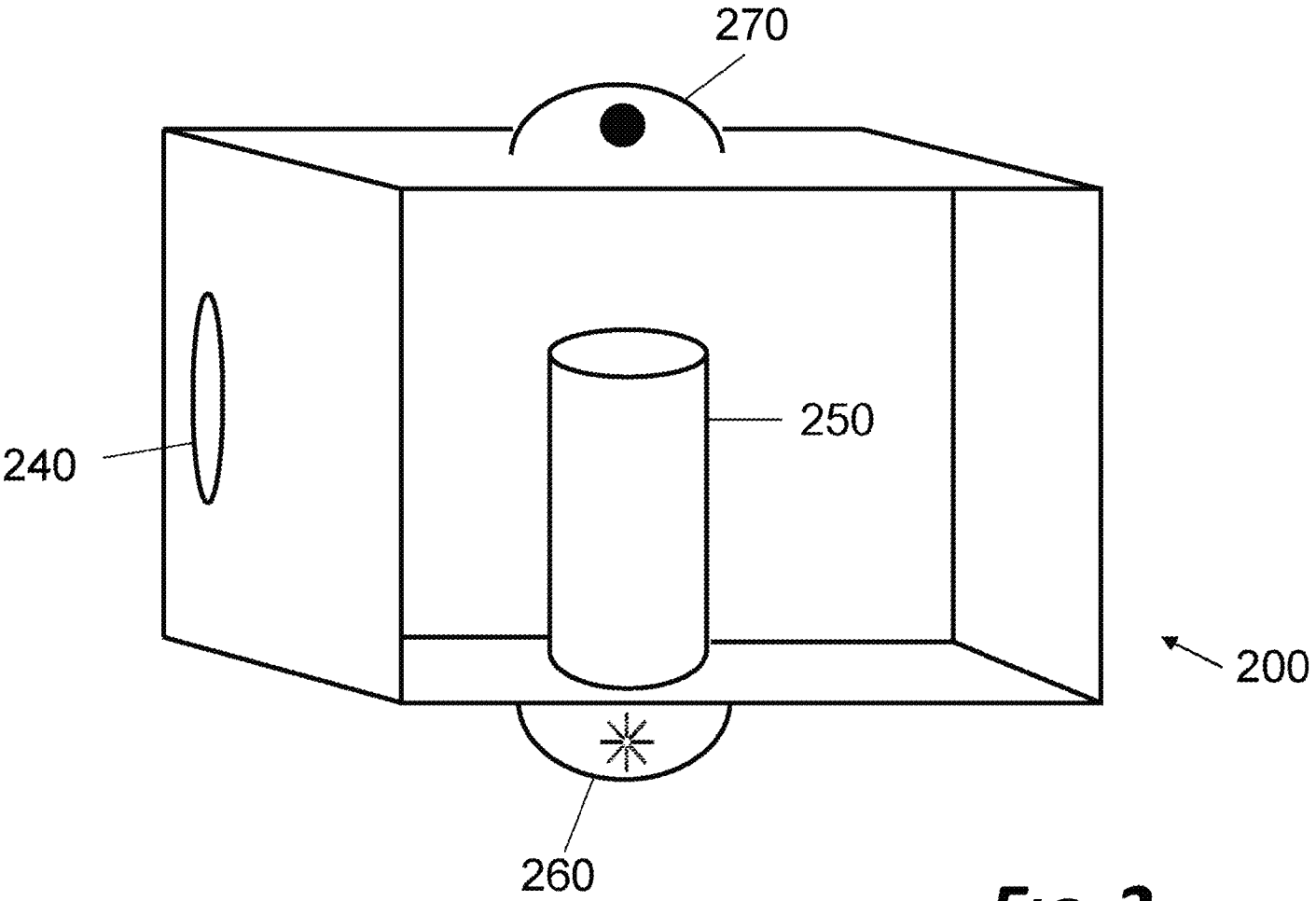
FIG. 2 is a perspective view of an alarm enclosure according to an exemplary embodiment.

FIG. 2 shows an alarm enclosure 200 that can be equipped with numerous alarm mechanisms and may house a self-defense item 250. An audio speaker 240 can be positioned on a side of the alarm enclosure 200. In one embodiment, the speaker 240 can be positioned symmetrically on opposing outer sides of the enclosure 200. In another embodiment, only one side may have the speaker 240. The enclosure may have a light or strobe light 260 positioned on a bottom surface, though the strobe light 260 can be positioned on any surface that provides a maximum effect of the strobe light 260 during activation. A video recording camera 270 can be positioned on a top surface of the enclosure 200, though the camera 270 can be positioned on any surface that provides a maximum effect of the camera 270. The second chamber of the enclosure 200 may be positioned in the rear of the enclosure 200 and may house the electronics associated with the audio speaker 240, strobe light 260, and video camera 270. The electrical components may include a processor and interface that allows the device to receive a signal from a trigger of the alarm, transmit a signal to a camera, light, horn or other notification device, and transmit a signal to a control panel for further processing.

Figure 3:
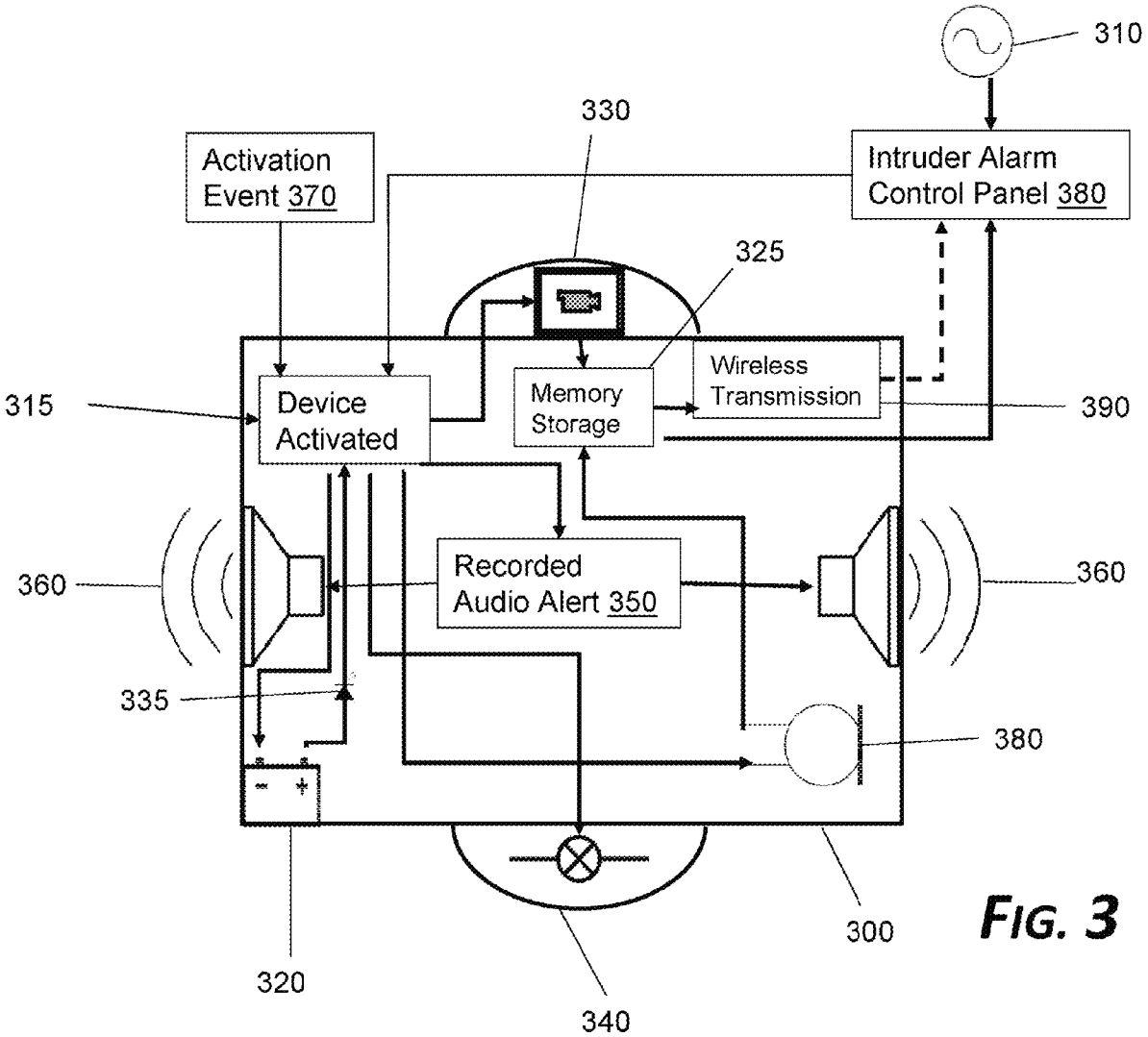
FIG. 3 is a schematic overview of an alarm system according to an exemplary embodiment.

FIG. 3 shows exemplary components of an alarm system in an enclosure 300. In this exemplary embodiment, the components shown in FIG. 3 may be housed in a second chamber. The system can derive power from electrical power of a building 310 and/or from an internal disposable battery 320. A light emitting diode (LED) 335 can assist users in knowing if the internal disposable battery 320 is functioning (green) or nonfunctioning (off).

The alarm system can be activated by an activation event 370 or directly from the intruder alarm control panel 380. An activation event is when a door of the enclosure is opened or removed. An activated alarm requires triggering of at least one alarm mechanism. Externally, shown on a top side of the enclosure 300, a protected video camera 330 can begin recording upon opening of the door. Furthermore, the protected video camera can record as a continuous loop. The recorded information can be stored internally on a memory storage device 325 (e.g., solid state drive, flash drive, removable memory device). It would likely have a finite storage internally and continually overwrite itself for any interval that the internal storage memory allows. The recorded video can also be transmitted via hardwiring or via wireless transmission 390 to the central control panel. Options would include wireless transmission to the central control panel to begin at the time of alarm activation.

Also upon activation, voice can be recorded via a microphone 380. The audio can be stored internally 325 and transmitted via direct connection or via a wireless transmission 390.

Additionally, any type of light would begin to shine upon activation of the device. The light is ideally a rotating strobe light 340 that begins to flash once the door is opened. In one alternative embodiment, the strobe light 340 may be a rotating strobe light. An audio alert 350 may also be triggered, which may send a horn, message (e.g., recording of a voice saying "intruder alert," "emergency," "code red," or "hide yourself"), or other audio to be emitted from speakers 360.

Figure 4:
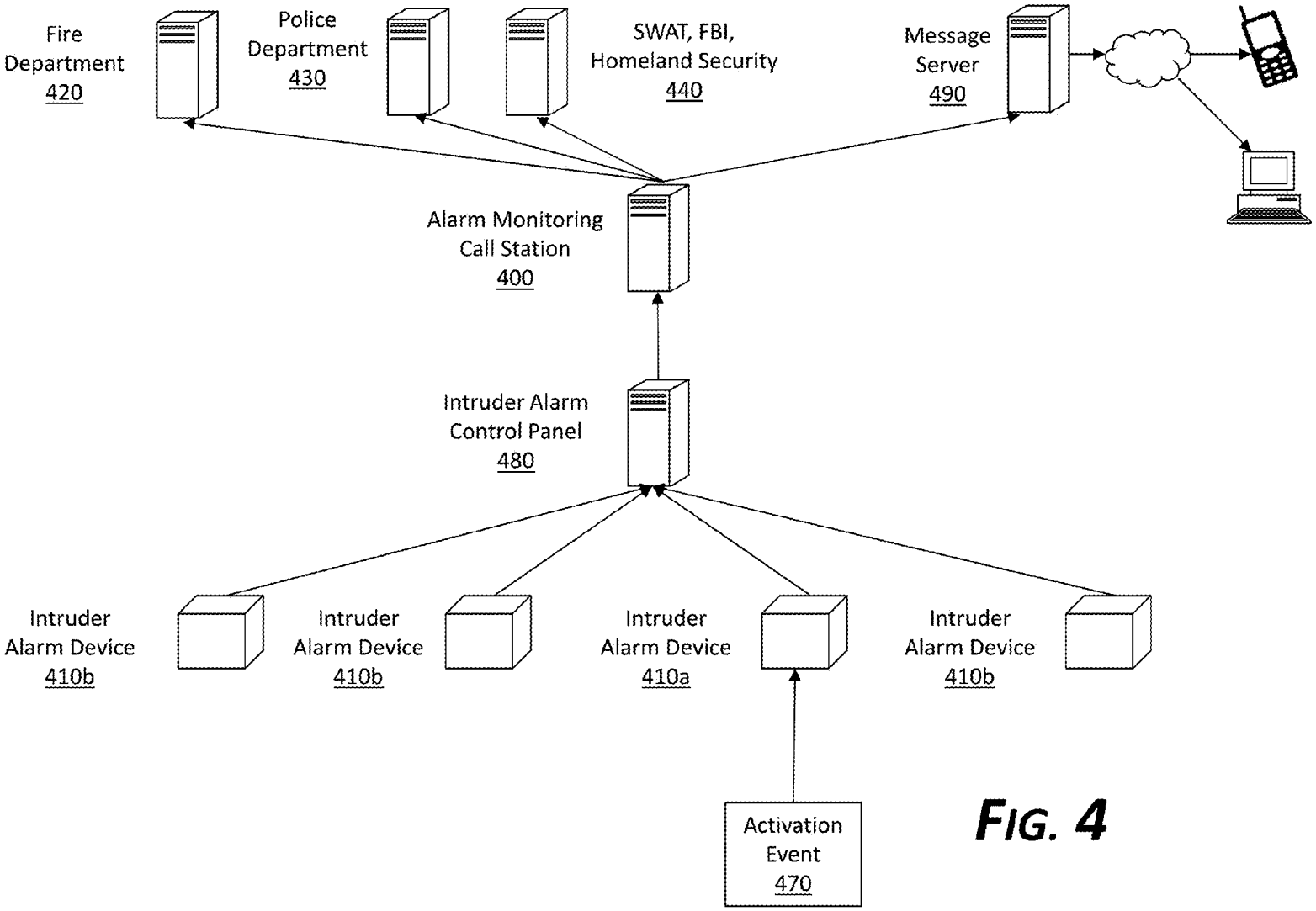
FIG. 4 is a schematic overview of the integrated alarm notification system triggered by an activation event.

FIG. 4 demonstrates how an activation event 470 triggers a cascade of notifications via an intruder alarm control panel 480. Once an intruder alarm device 410*a* is activated at a location, the intruder alarm control panel 480 can activate other intruder alarm devices 410*b* designated to go off within a location. All intruder alarm devices 410*a*, 410*b* can activate their cameras 330, strobe lights 340, speakers 360, and microphones 380. The intruder alarm control panel 480 also notifies an alarm monitoring call station 400. The intruder alarm control panel 480 has a processor that is programmed to recognize input signals from the alarm devices 410*a*, 410*b*, transmit a signal back to the alarm devices 410*a*, 410*b*, and transmit a signal to an alarm monitoring call station 400. The alarm monitoring call station 400 is able to monitor the video and audio recording from the activated intruder alarm devices 410*a*, 410*b*. The alarm monitoring call station 400 has a processor that is programmed to recognize input signals from the intruder alarm control panel 480, transmit a signal back to the intruder alarm control panel 480, and transmit a signal to other locations for processing and notification. The alarm monitoring call station 400 and/or the intruder alarm control panel 480 may have a storage device to store information about the signals (e.g., timestamp, location) and an audio or video feed (e.g., from a camera at an alarm device 410*a*). The alarm monitoring call station 400 is able to review the video and audio feed by a secured website or other means.

The alarm monitoring call station 400 can then notify first responders, such as local police department 430, and/or a local fire department 420. Because of the video and audio feed able to be readily obtained, further authorities including SWAT team, FBI and Homeland Security 440 can be notified more rapidly. The alarm can also trigger a message server 490 to send a text message, email message, or other notification message over a network (e.g., the internet, a cellular network) to designated recipients for viewing on a computing device, such as a smart phone, cellular phone, personal computer, tablet computer, gaming console, or other computing device.

Figure 5:
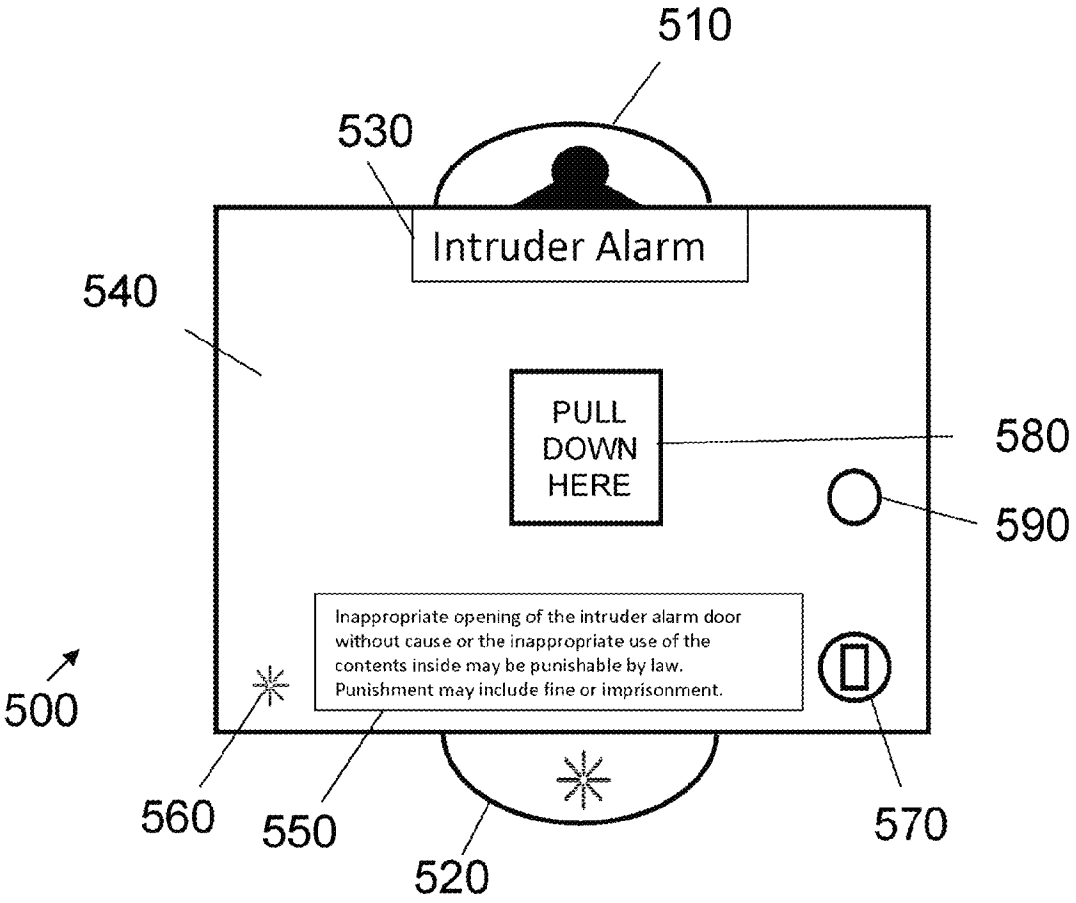
FIG. 5 is a frontal view of a single action alarm enclosure according to an exemplary embodiment.

FIG. 5 shows a front door 540 of an enclosure opened via a single action mechanism. As shown in this frontal view, a video camera 510 and strobe light 520 can be seen extending from the top and bottom sides, respectively. The door 540 may include a label 530, such as "Intruder Alarm." The label 530 may be visible from far distances or use a color that is recognizable for easier location of the alarm enclosure. A second label 550 may include a warning that may state the following: "Inappropriate opening of the intruder alarm door without cause or the inappropriate use of the contents inside may be punishable by law. Punishment may include fine or imprisonment." An LED indicator 560 demonstrates that the internal battery 320 is properly functioning. A key-lock mechanism 570 allows the user or emergency personnel to access the intruder alarm without triggering the device. The microphone 590 can be placed on the door, side, and/or inside the device. The door can be opened via a single action mechanism such as a pull down handle 580 that unlocks the door. The mechanism of opening the door is clearly labeled. The single action mechanism chosen should minimize accidental opening. A recessed pull down handle would be ideal for a single action mechanism.

Figure 6:
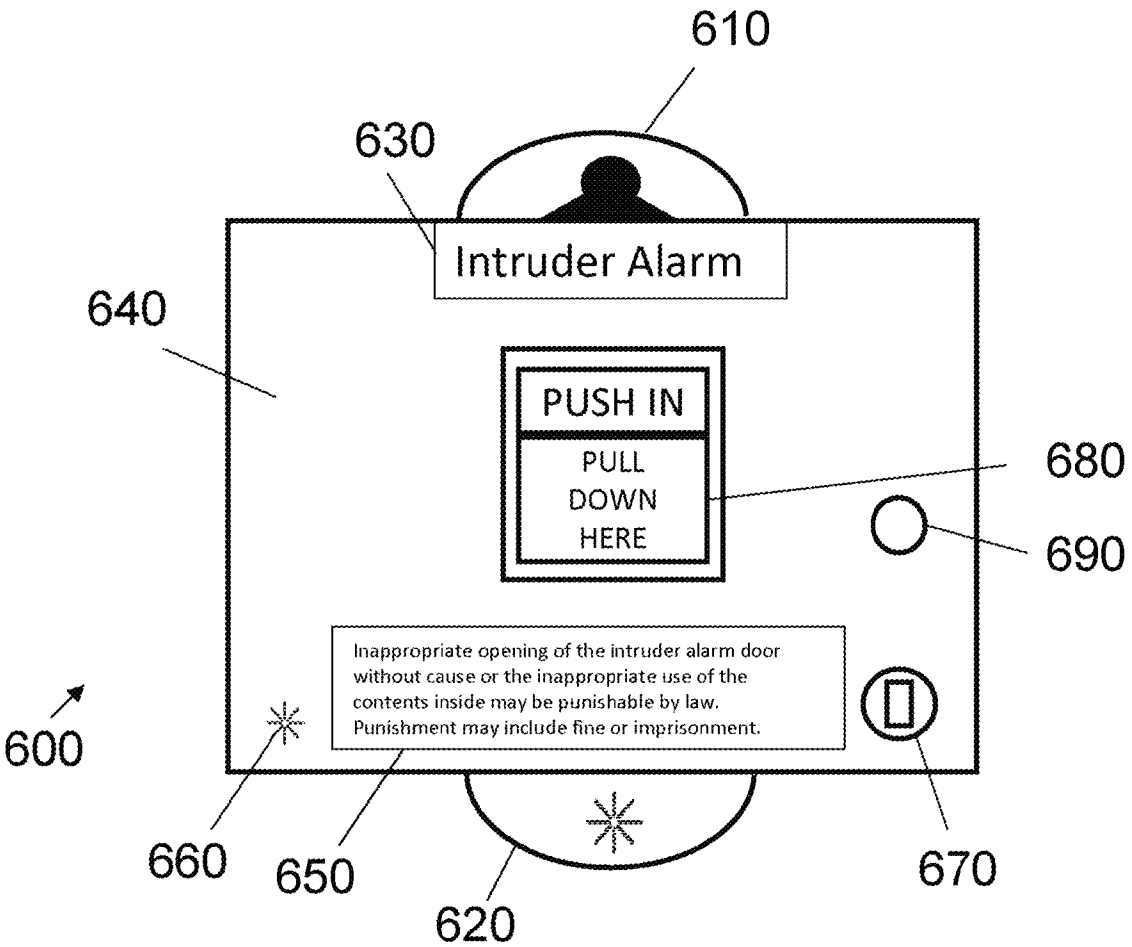
FIG. 6 is a frontal view of a multi-step action alarm enclosure according to an exemplary embodiment.

FIG. 6 shows a front door 640 of an enclosure opened via a multi-action mechanism 680. In an exemplary embodiment, the multi-action mechanism can be a recessed handle that requires the user to push in at the specified location before pulling down a sliding mechanism. A video camera 610, strobe light 620, and microphone 690 may still be employed, and the door 640 may include a label 630 and second label 650. The door 640 may also have a battery LED 660 and an emergency personnel keyed-lock 670. In public locations, where the majority of patrons are adults, a building owner or manager may choose to install a single or multi-action mechanism to open the door and activate the alarm.

Figure 7:
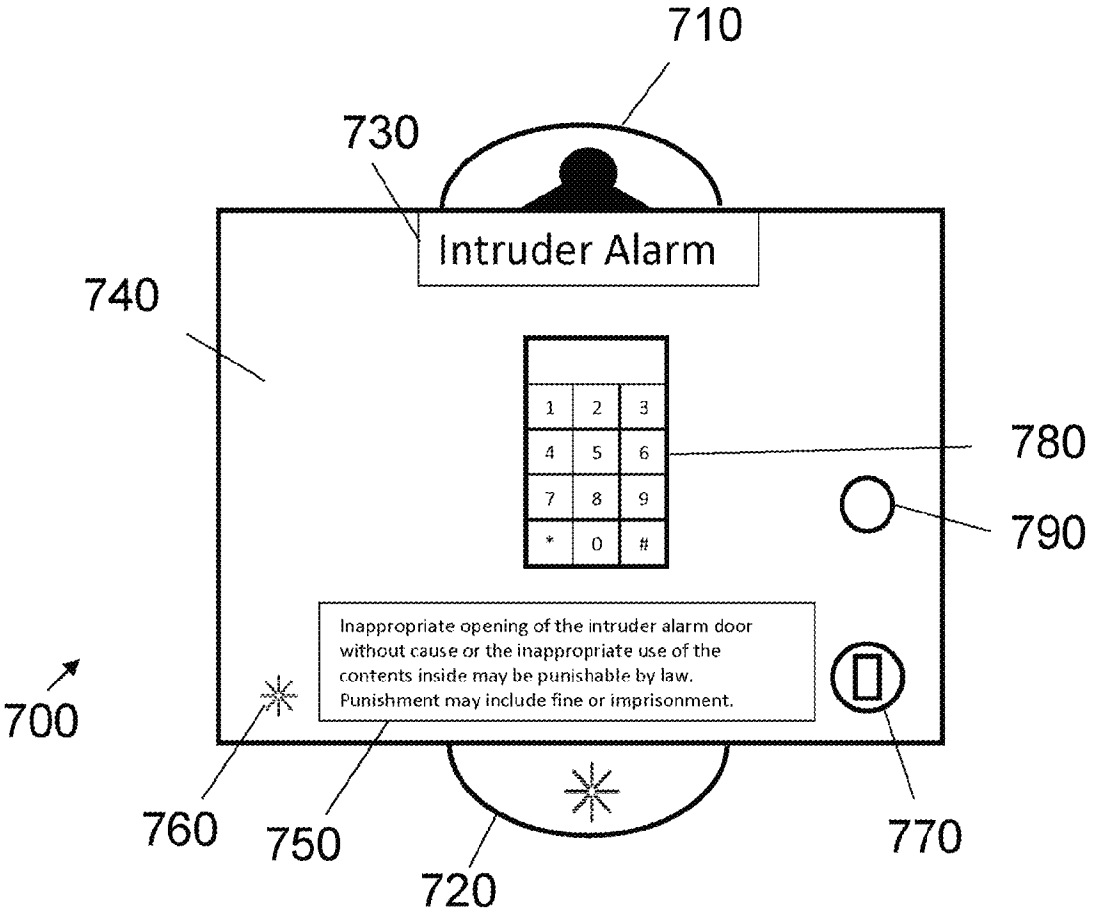
FIG. 7 is a frontal view of a numeric key pad alarm enclosure according to an exemplary embodiment.

FIG. 7 shows a front door 740 of an enclosure opened via an alphanumeric keypad 780. By entering a code known to certain individuals or to all people within a location, the door is able to be opened. In this exemplary embodiment, entering a multiple digit number can keep the enclosure secured. A locked door alarm enclosure likely would be used in locations with a predominance of children, such as schools. Teachers or appropriate personnel can be informed of the 2 to 4 digit code needed to be inputted into the keypad 780 to unlock the enclosure. A video camera 710, strobe light 720, and microphone 790 may still be employed, and the door 740 may include a label 730 and second label 750. The door 740 may also have a battery LED 760 and an emergency personnel keyed-lock 770.

It is to be appreciated that the various components of the technology can be located at distant portions of a distributed network and/or the Internet, or within a dedicated secure, unsecured and/or encrypted system. Thus, it should be appreciated that the components of the system can be combined into one or more devices or co-located on a particular node of a distributed network, such as a telecommunications network. As will be appreciated from the description, and for reasons of computational efficiency, the components of the system can be arranged at any location within a distributed network without affecting the operation of the system. Moreover, the components could be embedded in a dedicated machine.

Furthermore, it should be appreciated that the various links connecting the elements can be wired or wireless links, or any combination thereof, or any other known or later developed element(s) that is capable of supplying and/or communicating data to and from the connected elements. The term module as used herein can refer to any known or later developed hardware, software, firmware, or combination thereof that is capable of performing the functionality associated with that element. The terms determine, calculate and compute, and variations thereof, as used herein are used interchangeably and include any type of methodology, process, mathematical operation or technique.

The embodiments described above are intended to be exemplary. One skilled in the art recognizes that there are numerous alternative components and embodiments that may be substituted for or included in the particular examples described herein and such additions or substitutions still fall within the scope of the invention.

What is claimed is:

1. An alarm device comprising:

an enclosure configured to be secured to a wall in a publicly accessible location, the enclosure comprising a door to access an interior of the enclosure;

a removable self-defense item in the interior of the enclosure that is accessible by opening or removing the door, wherein accessing the removable self-defense item activates an alarm signal of the enclosure;

an audio or visual notification device associated with and electrically coupled to the enclosure, wherein the audio or visual notification is activated upon activation of the alarm signal;

a microphone electronically coupled to the enclosure and configured to automatically record an audio signal upon activation of the alarm signal of the enclosure;

a camera electronically coupled to the enclosure and configured to automatically record a video signal upon activation of the alarm signal of the enclosure; and a message transmission system electrically coupled to the enclosure that sends a notification message to a first responder entity.

2. The alarm device according to claim 1, wherein the door is locked until a user triggers an alarm.

3. The alarm device according to claim 1, further comprising a locking mechanism to keep the door in a locked position.

4. The alarm device according to claim 3, wherein the locking mechanism comprises a biometric lock, a key access, a badge access, or a keypad access.

5. The alarm device according to claim 1, wherein the audio or visual notification device is selected from the group consisting of a horn, a strobe light, and a recorded message.

6. The alarm device according to claim 1, wherein the self-defense item comprises oleoresin capsicum.

7. The alarm device according to claim 1, wherein the self-defense item comprises a loaded firearm.

8. The alarm device according to claim 1, wherein the self-defense item is selected from the group consisting of pepper spray, bear spray, tear gas, stun gun, taser, loaded firearm, and an unloaded firearm.

9. The alarm device according to claim 1, wherein unlocking the door activates the alarm signal.

10. The alarm device according to claim 1, further comprising a second alarm device that is configured to activate an audio or visual notification associated with the second alarm device upon receiving the alarm signal from the alarm device.

11. The alarm device according to claim 10, further comprising a second camera electronically coupled to the second alarm device and configured to automatically record a video signal upon activation of the alarm signal.

12. An alarm system comprising:

at least one alarm device enclosing a self-defense item that is accessible upon an alarm trigger;

a control panel electronically coupled to the at least one alarm device and is configured to receive a notification from an alarm device that has received an alarm trigger; and an alarm monitoring call station electronically coupled to the control panel and is configured to transmit messages to a first responder entity.

13. The alarm system according to claim 12, further comprising a server electronically coupled to the alarm monitoring call station and configured to transmit a notification regarding the alarm to a remote computing device.

14. The alarm system according to claim 13, wherein the remote computing device is a personal computer, cellular phone, smartphone, or a tablet computer.

15. The alarm system according to claim 13, wherein the notification is a text message or an email message.

16. The alarm device according to claim 1, wherein the self-defense item comprises oleoresin capsicum.

17. The alarm device according to claim 13, wherein the self-defense item is selected from the group consisting of pepper spray, bear spray, tear gas, stun gun, taser, loaded firearm, and an unloaded firearm.

18. A method for activating an alarm, the method comprising:

unlocking a door of an alarm device, thereby allowing access to a removable self-defense item and activating an alarm trigger; and upon receiving the alarm trigger:

activating an audio or visual notification associated with the alarm device;

automatically recording a video signal of a camera and an audio signal of a microphone associated with the alarm device; and transmitting an alarm signal to a central control panel.

19. The method according to claim 18, further comprising activating an alarm notification of a second alarm device that was not triggered.

20. The method according to claim 18, further comprising transmitting a signal to instruct recording a video signal from a camera associated with a second alarm device that was not triggered.

* * * * *